US012104836B2

(12) United States Patent
Yang

(10) Patent No.: US 12,104,836 B2
(45) Date of Patent: Oct. 1, 2024

(54) REFRIGERANT BYPASS SOLUTION

(71) Applicant: SCHNEIDER ELECTRIC IT CORPORATION, Foxboro, MA (US)

(72) Inventor: Hongwei Yang, Shanghai (CN)

(73) Assignee: SCHNEIDER ELECTRIC IT CORPORATION, Foxboro, MA (US)

( * ) Notice: Subject to any disclaimer, the term of this patent is extended or adjusted under 35 U.S.C. 154(b) by 0 days.

(21) Appl. No.: 18/533,290

(22) Filed: Dec. 8, 2023

(65) Prior Publication Data

US 2024/0102710 A1 Mar. 28, 2024

Related U.S. Application Data

(63) Continuation of application No. 17/480,580, filed on Sep. 21, 2021, now Pat. No. 11,859,884.

(30) Foreign Application Priority Data

Aug. 31, 2020 (CN) ..... 202010895790.X

(51) Int. Cl.
*F25B 49/02* (2006.01)
*F25B 31/00* (2006.01)
(Continued)

(52) U.S. Cl.
CPC ..... *F25B 49/02* (2013.01); *F25B 31/004* (2013.01); *F25B 41/20* (2021.01); *F25B 43/02* (2013.01);
(Continued)

(58) Field of Classification Search
CPC ..... F25B 49/02; F25B 41/20; F25B 31/004; F25B 43/02; F25B 2400/04;
(Continued)

(56) References Cited

U.S. PATENT DOCUMENTS

| | | | |
|---|---|---|---|
| 5,927,101 | A | 7/1999 | Oh |
| 2019/0242622 | A1 | 8/2019 | Matsuda et al. |
| 2021/0102720 | A1 | 4/2021 | Snell et al. |

FOREIGN PATENT DOCUMENTS

| | | | |
|---|---|---|---|
| CN | 2682346 | Y | 3/2005 |
| CN | 104296413 | A | 1/2015 |

(Continued)

OTHER PUBLICATIONS

Pdf is translation of foreign reference JP 2016138677 A (Year: 2016).*

(Continued)

*Primary Examiner* — Henry T Crenshaw
*Assistant Examiner* — Kamran Tavakoldavani
(74) *Attorney, Agent, or Firm* — Lando & Anastasi, LLP

(57) ABSTRACT

Systems, methods, and computer-readable mediums are provided for improving the efficiency of a filter-type oil separator in a cooling system including a compressor that pumps a mixture of lubricating oil and refrigerant through the filter-type oil separator. The filter type oil separator is configured to receive a first portion of the mixture from the compressor, and a bypass line is configured to bypass a second portion of the mixture around the filter-type oil separator. The bypass line ensures a sufficient amount of oil is present in the compressor.

20 Claims, 15 Drawing Sheets

(51) Int. Cl.
*F25B 41/20* (2021.01)
*F25B 43/02* (2006.01)

(52) U.S. Cl.
CPC .... *F04C 2270/052* (2013.01); *F04C 2270/09* (2013.01); *F04C 2270/20* (2013.01); *F25B 2400/04* (2013.01); *F25B 2400/0401* (2013.01); *F25B 2500/19* (2013.01); *F25B 2600/2501* (2013.01); *F25B 2700/1931* (2013.01); *F25B 2700/1933* (2013.01)

(58) Field of Classification Search
CPC ..... F25B 2400/0401; F25B 2500/19; F25B 2600/2501; F25B 2700/1931; F25B 2700/1933; F25B 31/002; F25B 2400/0413; F25B 2400/0415; F25B 2500/16; F25B 2700/171; F04B 39/02
See application file for complete search history.

(56) References Cited

FOREIGN PATENT DOCUMENTS

| | | | | |
|---|---|---|---|---|
| CN | 107906777 | A | | 4/2018 |
| CN | 110325804 | A | | 10/2019 |
| CN | 111121351 | A | | 5/2020 |
| DE | 102006000690 | A1 | | 7/2007 |
| JP | 2004085035 | A | | 3/2004 |
| JP | 2004085036 | A | | 3/2004 |
| JP | 2004251570 | A | | 9/2004 |
| JP | 2016138677 | A | * | 8/2016 |
| JP | 2018169064 | A | | 11/2018 |

OTHER PUBLICATIONS

Extended European Search Report from corresponding European Application No. 21193752.9 dated Jan. 24, 2022.

* cited by examiner

REFRIGERANT BYPASS SOLUTION

CROSS-REFERENCE TO RELATED APPLICATION

This application is as a continuation of U.S. application Ser. No. 17/480,580, titled REFRIGERANT BYPASS SOLUTION, filed on Sep. 21, 2021, which claims the benefit under 35 U.S.C. § 119 of Chinese Patent Application Serial No. 202010895790.X, filed on Aug. 31, 2020. Each application referenced above is hereby incorporated by reference in its entirety for all purposes.

FIELD

Embodiments of the present disclosure generally relate to maintaining a sufficient level of lubricating oil in a compressor of a cooling system.

BACKGROUND

In some cooling systems, oil separators are used to remove lubricating oil from a mixture of lubricating oil and refrigerant vapor pumped by a compressor. One type of known oil separator is a centrifugal oil separator that achieves oil separation by centrifugally forcing the mixture along a spiraling path causing oil particles to move outward towards a screen. Another type of known oil separator is a filter-type oil separator. The filter-type oil separator achieves oil separation by passing the mixture through baffling and filters, thereby causing oil particles to combine and form heavier particles as they flow down an inner wall of the separator. The oil particles accumulate at the bottom of the filter-type oil separator and are returned to the compressor while the refrigerant within the filter-type oil separator passes through an outlet and enters a condenser.

SUMMARY

According to at least one aspect of the present disclosure, a system improving efficiency of a filter-type oil separator is provided, the system comprising a compressor configured to compress and pressurize a mixture of refrigerant and lubricant, a filter-type oil separator configured to receive a first portion of the compressed mixture of refrigerant and lubricant from the compressor, and a bypass line configured to bypass a second portion of the compressed mixture of refrigerant and lubricant around the filter-type oil separator.

In one embodiment, the system further comprises a bypass valve configured to receive the second portion of the mixture of refrigerant and lubricant and provide a bypass path around the filter-type oil separator for the second portion of the mixture.

In an embodiment, the bypass line includes the bypass valve.

In one embodiment, the system further comprises a controller configured to process one or more input signals, determine a speed value of the compressor based on the one or more input signals, and adjust the bypass valve based on the speed value.

In an embodiment, the compressor is a variable speed compressor, and the one or more input signals represent a driving frequency of the compressor.

In one embodiment, the controller is configured to determine the speed value by calculating a value of refrigerant gas flow rate at a discharge side of the compressor and determining a correspondence between compressor revolutions per second (RPS) and the calculated refrigerant gas flow rate.

In an embodiment, the controller is configured to calculate the value of refrigerant gas flow rate by receiving a first pressure value from a first pressure transducer at a suction side of the compressor, receiving a second pressure value from a second pressure transducer at the discharge side of the compressor, receiving compressor flow coefficients from a storage, and determining the speed value as a function of the first pressure value, the second pressure value, and the compressor flow coefficients.

In one embodiment, when adjusting the bypass valve based on the speed value, the controller is configured to open the bypass valve in response to determining the speed value exceeds a threshold and the bypass valve is not already open, and close the bypass valve in response to determining the speed value is less than or equal to the threshold and the bypass valve is not already closed.

In an embodiment, the threshold is a predetermined compressor speed value.

In one embodiment, when adjusting the bypass valve based on the speed value, the controller is configured to adjust the bypass valve to a first predetermined percentage of openness in response to determining the speed value exceeding a threshold, adjust the bypass valve to a second predetermined percentage of openness, the second predetermined percentage being more than the first predetermined percentage, in response to determining the speed value increased, and adjust the bypass valve to a third predetermined percentage of openness, the third predetermined percentage being less than the first predetermined percentage, in response to determining the speed value decreased.

In an embodiment, the bypass valve is adjusted according to a non-linearly increasing relationship between a predetermined range of bypass valve openness percentages and a range of predetermined speed values, wherein percentage values in the predetermined range of the bypass valve openness percentages non-linearly increase as speed values in the range of predetermined speed values increase.

In one embodiment, the bypass valve is adjusted according to a linearly increasing relationship between a predetermined range of the bypass valve openness percentages and a range of predetermined speed values, wherein percentage values in the predetermined range of the bypass valve openness percentages linearly increase as speed values in the range of predetermined speed values increase.

In an embodiment, the bypass valve is a ball valve.

In one embodiment, the bypass valve is a hot gas bypass valve.

According to at least one aspect of the present disclosure, a method of improving efficiency of a filter-type oil separator in a system including a compressor, a filter-type oil separator, and a bypass line configured to bypass the filter-type oil separator is provided, the method comprising compressing and pressurizing, by the compressor, a mixture of refrigerant and lubricant, receiving, by the filter-type oil separator, a first portion of the compressed mixture of refrigerant and lubricant from the compressor, and bypassing a second portion of the compressed mixture of refrigerant and lubricant around the filter-type oil separator with the bypass line.

In one embodiment, the bypass line includes a bypass valve, and the bypassing step further comprises processing, by a controller, one or more input signals, determining, by the controller, a speed value of the compressor based on the one or more input signals, and adjusting, by the controller, the bypass valve based on the speed value.

In an embodiment, the processing and determining steps are repeated at a predetermined time interval.

In one embodiment, the controller determines the speed value by calculating a value of refrigerant gas flow rate at a discharge side of the compressor and determining a correspondence between compressor revolutions per second (RPS) and the calculated refrigerant gas flow rate.

In an embodiment, the controller calculates the value of refrigerant gas flow rate by receiving a first pressure value from a first pressure transducer at a suction side of the compressor, receiving a second pressure value from a second pressure transducer at the discharge side of the compressor, receiving compressor flow coefficients from a storage, and determining the speed value as a function of the first pressure value, the second pressure value, and the compressor flow coefficients.

In one embodiment, the compressor is a variable speed compressor, and the one or more input signals represent a driving frequency of the compressor.

In an embodiment, the adjustment step further comprises opening the bypass valve in response to determining the speed value exceeds a threshold and the bypass valve is not already open, and closing the bypass valve in response to determining the speed value is less than or equal to the threshold and the bypass valve is not already closed.

In one embodiment, the threshold is a predetermined compressor speed value.

In an embodiment, the adjustment step further comprises adjusting the bypass valve to a first predetermined percentage of openness in response to determining the speed value exceeding a threshold, adjusting the bypass valve to a second predetermined percentage of openness, the second predetermined percentage being more than the first predetermined percentage, in response to determining the speed value increased, and adjusting the bypass valve to a third predetermined percentage of openness, the third predetermined percentage being less than the first predetermined percentage, in response to determining the speed value decreased.

In one embodiment, the bypass valve is adjusted according to a non-linearly increasing relationship between a predetermined range of bypass valve openness percentages and a range of predetermined speed values, wherein percentage values in the predetermined range of bypass valve openness percentages non-linearly increase as speed values in the range of predetermined speed values increase.

In an embodiment, the bypass valve is adjusted according to a linearly increasing relationship between a predetermined range of bypass valve openness percentages and a range of predetermined speed values, wherein percentage values in the predetermined range of bypass valve openness percentages linearly increase as speed values in the range of predetermined speed values increase.

According to at least one aspect of the present disclosure, a non-transitory computer-readable medium storing thereon sequences of computer-executable instructions is provided to instruct a controller to command a compressor to compress and pressurize a mixture of refrigerant and lubricant, the compressor being coupled to a bypass line including a bypass valve, and the compressor being coupled to a filter-type oil separator configured to receive a first portion of the compressed mixture of refrigerant and lubricant from the compressor, process one or more input signals, determine a speed value of the compressor based on the one or more input signals, and adjust the bypass valve included in the bypass line based on the speed value, the bypass line being configured to bypass a second portion of the compressed mixture of refrigerant and lubricant around the filter-type oil separator.

In one embodiment, the processing and determining steps are repeated at a predetermined time interval.

In an embodiment, the controller determines the speed value by calculating a value of refrigerant gas flow rate at a discharge side of the compressor and determining a correspondence between compressor revolutions per second (RPS) and the calculated refrigerant gas flow rate.

In one embodiment, the controller calculates the value of refrigerant gas flow rate by receiving a first pressure value from a first pressure transducer at a suction side of the compressor, receiving a second pressure value from a second pressure transducer at the discharge side of the compressor, receiving compressor flow coefficients from a storage, and determining the speed value as a function of the first pressure value, the second pressure value, and the compressor flow coefficients.

In an embodiment, the compressor is a variable speed compressor, and the one or more input signals represent a driving frequency of the compressor.

In one embodiment, the adjustment step further comprises opening the bypass valve in response to determining the speed value exceeds a threshold and the bypass valve is not already open, and closing the bypass valve in response to determining the speed value is less than or equal to the threshold and the bypass valve is not already closed.

In an embodiment, the threshold is a predetermined compressor speed value.

In one embodiment, the adjustment step further comprises adjusting the bypass valve to a first predetermined percentage of openness in response to determining the speed value exceeding a threshold, adjusting the bypass valve to a second predetermined percentage of openness, the second predetermined percentage being more than the first predetermined percentage, in response to determining the speed value increased, and adjusting the bypass valve to a third predetermined percentage of openness, the third predetermined percentage being less than the first predetermined percentage, in response to determining the speed value decreased.

In an embodiment, the bypass valve is adjusted according to a non-linearly increasing relationship between a predetermined range of bypass valve openness percentages and a range of predetermined speed values, wherein percentage values in the predetermined range of bypass valve openness percentages non-linearly increase as speed values in the range of predetermined speed values increase.

In one embodiment, the bypass valve is adjusted according to a linearly increasing relationship between a predetermined range of bypass valve openness percentages and a range of predetermined speed values, wherein percentage values in the predetermined range of bypass valve openness percentages linearly increase as speed values in the range of predetermined speed values increase.

According to at least one aspect of the present disclosure, a method of assembling a system improving efficiency of a filter-type oil separator is provided, the method comprising providing a compressor, a filter-type oil separator, and a bypass line, coupling the compressor to the filter-type oil separator, coupling the compressor to the bypass line, and coupling the filter-type oil separator to the bypass line, wherein the compressor is configured to compress and pressurize a mixture of refrigerant and lubricant, the filter-type oil separator is configured to receive a first portion of the compressed mixture of refrigerant and lubricant from the compressor, and the bypass line is configured to bypass a second portion of the compressed mixture of refrigerant and lubricant around the filter-type oil separator.

In one embodiment, the method further comprises coupling a bypass valve to the bypass line, the bypass valve being configured to receive the second portion of the mixture of refrigerant and lubricant and provide a bypass path around the filter-type oil separator for the second portion of the mixture.

In an embodiment, the bypass line includes the bypass valve.

In one embodiment, the method further comprises coupling a controller to the bypass valve, the controller configured to process one or more input signals, determine a speed value of the compressor based on the one or more input signals, and adjust the bypass valve based on the speed value.

In an embodiment, the compressor is a variable speed compressor, and the one or more input signals represent a driving frequency of the compressor.

In one embodiment, the controller is configured to determine the speed value by calculating a value of refrigerant gas flow rate at a discharge side of the compressor and determining a correspondence between compressor revolutions per second (RPS) and the calculated refrigerant gas flow rate.

In an embodiment, the controller is configured to calculate the value of refrigerant gas flow rate by receiving a first pressure value from a first pressure transducer at a suction side of the compressor, receiving a second pressure value from a second pressure transducer at the discharge side of the compressor, receiving compressor flow coefficients from a storage, and determining the speed value as a function of the first pressure value, the second pressure value, and the compressor flow coefficients.

In one embodiment, when adjusting the bypass valve based on the speed value, the controller is further configured to open the bypass valve in response to determining the speed value exceeds a threshold and the bypass valve is not already open, and close the bypass valve in response to determining the speed value is less than or equal to the threshold and the bypass valve is not already closed.

In an embodiment, the threshold is a predetermined compressor speed value.

In one embodiment, when adjusting the bypass valve based on the speed value, the controller is further configured to adjust the bypass valve to a first predetermined percentage of openness in response to determining the speed value exceeding a threshold, adjust the bypass valve to a second predetermined percentage of openness, the second predetermined percentage being more than the first predetermined percentage, in response to determining the speed value increased, and adjust the bypass valve to a third predetermined percentage of openness, the third predetermined percentage being less than the first predetermined percentage, in response to determining the speed value decreased.

In an embodiment, the bypass valve is adjusted according to a non-linearly increasing relationship between a predetermined range of bypass valve openness percentages and a range of predetermined speed values, wherein percentage values in the predetermined range of the bypass valve openness percentages non-linearly increase as speed values in the range of predetermined speed values increase.

In one embodiment, the bypass valve is adjusted according to a linearly increasing relationship between a predetermined range of the bypass valve openness percentages and a range of predetermined speed values, wherein percentage values in the predetermined range of the bypass valve openness percentages linearly increase as speed values in the range of predetermined speed values increase.

In an embodiment, the bypass valve is a ball valve.

In one embodiment, the bypass valve is a hot gas bypass valve.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed subject matter. Particular references to examples and embodiments, such as "an embodiment," "an example," "another embodiment," "another example," "some embodiments," "some examples," "other embodiments," "an alternate embodiment," "various embodiments," "one embodiment," "at least one embodiment," "this and other embodiments" or the like, are not necessarily mutually exclusive and re intended to indicate that a particular feature, structure, or characteristic described in connection with the embodiment or example and may be included in that embodiment or example and other embodiments or examples. The appearances of such terms herein are not necessarily all referring to the same embodiment or example.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
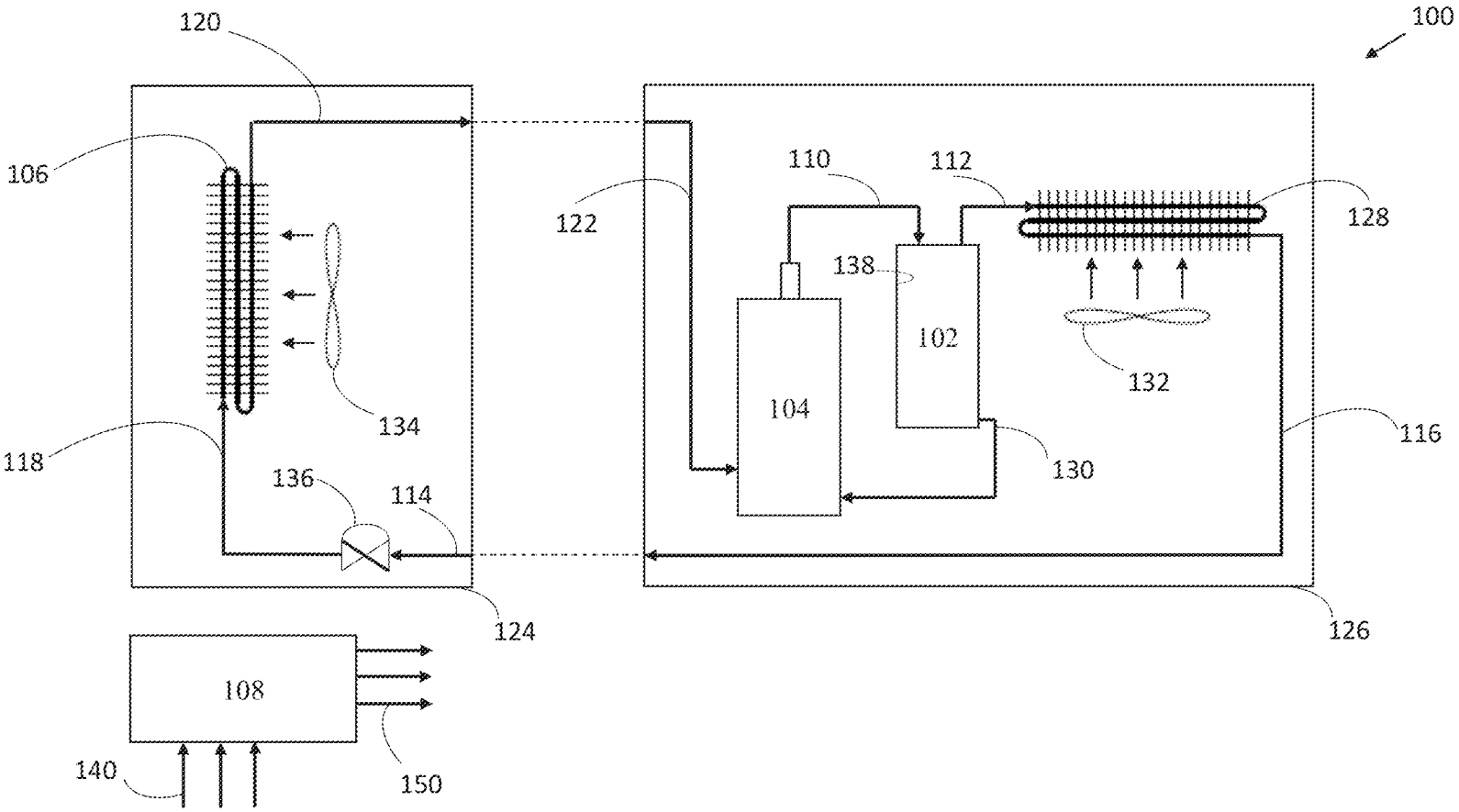
FIG. 1 is a block diagram of a cooling system, according to aspects described herein.

It is to be appreciated that embodiments of the methods, systems, and computer readable mediums discussed herein are not limited in application to the details of construction and the arrangement of components set forth in the following description or illustrated in the accompanying drawings. The methods and systems are capable of implementation in other embodiments and of being practiced or of being carried out in various ways. Examples of specific implementations are provided herein for illustrative purposes only and are not intended to be limiting. Also, the phraseology and terminology used herein is for the purpose of description and should not be regarded as limiting. As used herein, the term "plurality" refers to two or more items or components. The terms "comprising," "including," and "containing," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims. References to "or" may be construed as inclusive so that any terms described using "or" may indicate any of a single, more than one, and all of the described terms.

Aspects and embodiments described herein are generally directed to systems, methods, and computer-readable mediums for improving the efficiency of a filter-type oil separator in a cooling system including a compressor that pumps or transports a mixture of lubricating oil and refrigerant.

Oil in the compressor prevents abrasion between parts and reduces the power needed to drive the compressor. If the compressor is charged with too much oil, the power required to drive the compressor increases, thereby decreasing the compressor's efficiency. If there is an insufficient amount of oil in the compressor, durability may be reduced from increased friction. The amount of oil charge also affects the functionality of the oil separator, which thereby affects the amount of oil returning to the compressor.

The efficiency of a filter-type oil separator is highly related to refrigerant gas flow velocity. At low gas flow rates, which correspond to low compressor speeds, the efficiency of the filter-type oil separator is high and the oil level in the compressor is typically satisfactory. In some embodiments, a satisfactory oil level amount is no lower than one third of the level in a sight glass. However, at medium compressor speeds, especially over time, oil separator efficiency decreases, causing the oil level in the compressor to be unsatisfactorily low because the oil separator cannot reclaim enough oil to return to the compressor and the refrigerant suction piping cannot bring enough oil back to the compressor. At high compressor speeds, the oil level in the compressor increases because the suction piping of the compressor can bring more oil back to the compressor. However, even at high speeds, the oil level in the compressor is still significantly lower than the level at the medium speeds and the lower speeds, depending on the initial charge amount in the system. Medium and high compressor speeds exhibit decreased efficiencies of both the compressor and the filter-type oil separator. Thus, the amount of oil returned to the compressor is primarily dependent on compressor speed.

What is needed is a solution to improve the efficiency of the compressor and the efficiency of the filter-type oil separator by maintaining a sufficient amount of oil in the compressor and reclaiming a sufficient amount of oil with the filter-type oil separator.

FIG. 1 is a block diagram of a cooling system 100, according to aspects described herein. The cooling system 100 includes a condensing unit 126, which includes an oil separator subsystem 102, a compressor 104, a compressor discharge line 110, a condenser input line 112, a condenser output line 116, a suction line 122, a condenser 128, an oil return tube 130, and one or more condenser fans 132. The cooling system 100 also includes an InRow unit 124, which includes an evaporator 106, InRow input line 114, an evaporator input line 118, an evaporator output line 120 in fluid communication with the suction line 122, one or more evaporator fans 134, an expansion valve 136, and an inner wall 138 of oil separator subsystem 102. The cooling system 100 also includes a controller 108, one or more controller input lines 140, and one or more control lines 150.

In FIG. 1, each solid arrow or dashed line connected within or connected between InRow unit 124, condensing unit 126, and components thereof represents piping or tubing configured to transport and contain a mixture of liquid, gas, vapor, and/or oil. The solid arrows connecting components together indicate flow direction of a mixture. The separated arrows between condenser fan 132 and condenser 128, as well as those between evaporator fan 134 and evaporator 106 represent the direction of air flow. Separated and numbered arrows, such as the arrow pointing to system 100, indicate a component, system, subsystem, or configuration. Each solid arrow directly connected to controller 108 represents a conductive wire or set of wires that facilitates signal transfer between the controller 108 and any component within system 100 that is controllable. These conventions apply to FIG. 1, FIG. 2, FIG. 3, FIG. 4, FIG. 5, and FIG. 6.

The suction line 122 is coupled to the compressor 104 to provide fluid communication between the InRow unit 124 and the condensing unit 126. Compressor 104 is coupled to the compressor discharge line 110 at a discharge side of compressor 104. Discharge line 110 is coupled to oil separator subsystem 102 to provide a mixture of lubricating oil and high-pressure refrigerant from compressor 104 to oil separator subsystem 102. Oil separator subsystem 102 is coupled to oil return tube 130, which is coupled to compressor 104 to provide a return path for oil that accumulates in oil separator subsystem 102. Oil separator subsystem 102 is also coupled to condenser input line 112, which is coupled to condenser 128 to thereby provide a filtered mixture to condenser 128 having less oil than the mixture received by oil separator subsystem 102 from compressor discharge line 110. Condenser 128 is coupled to condenser output line 116.

Condenser output line 116 is coupled to InRow input line 114 to thereby provide fluid communication between condensing unit 126 and InRow unit 124. InRow input line 114 is coupled to expansion valve 136 to regulate the flow between the condenser 128 and the evaporator 106. Expansion valve 136 is coupled to evaporator input line 118. Evaporator input line 118 is coupled to evaporator 106, which is coupled to evaporator output line 120. Evaporator output line 120 is coupled to suction line 122 to thereby provide fluid communication between the InRow unit 124 and the condensing unit 126.

Controller 108 is coupled to one or more control lines 150. At least one of the one or more control lines 150 is coupled to compressor 104. In some embodiments, one of the one or more control lines 150 is coupled to compressor 104 and another control line 150 is coupled to oil separator subsystem 102. In some embodiments, controller 108 is coupled to one or more controller input lines 140 and one or more control lines 150. In some embodiments, controller 108 is located externally from one or both of the InRow unit 124 and the condensing unit 126. In some embodiments, controller 108 is coupled to no controller input lines 140. In some embodiments, controller 108 is included in one of the InRow unit 124 and the condensing unit 126. In some embodiments, controller 108 is distributed in one or more of the InRow unit 124, the condensing unit 126, and an area external to both of the InRow unit 124 and the condensing unit 126. Each aspect of controller 108 discussed herein applies to any controller of any embodiment disclosed herein. In some embodiments of system 100, the functionality of controller 108 is performed by special-purpose hardware. In some embodiments, controller 108 is coupled to electronic expansion valve 136 and one or more of each controllable component in system 100. In some embodiments, controllable components include compressor 104 and oil separator subsystem 102. In some embodiments, controllable components include compressor 104.

Compressor 104 includes lubricating oil configured to seal, cool and/or lubricate internal components within compressor 104. The compressor is configured to act as a pump to circulate refrigerant throughout system 100. Refrigerant leaving compressor 104 exits as a high temperature, high-pressure vapor. During operation of system 100, the lubricating oil within compressor 104 is discharged with the refrigerant into compressor discharge line 110.

In some embodiments, oil separator subsystem 102 includes a plurality of oil separators connected in parallel. In some embodiments, oil separator subsystem 102 includes a plurality of oil separators connected in series.

In some embodiments, compressor 104 is a scroll compressor. In some embodiments, compressor 104 is a variable speed compressor.

In some embodiments, a floating ball valve within an oil separator with oil separator subsystem 102 is used to automatically return the accumulated lubricating oil through oil return tube 130 to the crankcase of compressor 104.

Oil separator subsystem 102 is configured to receive a mixture of lubricating oil and refrigerant from the compressor discharge line 110. In some embodiments, oil subsystem 102 includes a filter-type oil separator. After the mixture of lubricating oil and high-pressure refrigerant enters the oil separator, the lubricating oil is separated from the mixture by gravity and/or filtering effect. In some embodiments, the filtering effect is achieved with mesh. The lubricating oil flows down along an inner wall 138 of the oil separator. The separated lubricating oil accumulates in the bottom of the oil separator and is discharged into oil return tube 130. Lubricating oil that is not removed by the oil separator enters condenser input line 112 and then the condenser 128. The more lubricating oil that is present in condenser 128, the more heat resistance increases within condenser 128, thereby reduces heat transfer efficiency. Lubricating oil that is not removed by the oil separator flows through system 100 and returns at a suction side of compressor 104.

As the high-pressure mixture flowing through condenser input line 112 passes through condenser 128, one or more condenser fans 132 move air over the condenser 128 to expel heat from condensing unit 126. As heat is expelled, high-pressure vapor in the mixture begins to change to a medium temperature, high-pressure liquid. The mixture leaving condenser 128 flows through condenser output line 116 and exits the condensing unit 126. In FIG. 1, the two dashed lines connecting condensing unit 126 and InRow unit 124 represent a continuous path for the mixture to flow.

The high-pressure liquid mixture flows through InRow input line 114 to electronic expansion valve 136. The electronic expansion valve 136 is controlled by controller 108 to regulate how much refrigerant mixture to let enter the evaporator 106. The mixture exits the expansion valve 136 into evaporator input line 118. As the mixture flows through evaporator 106, one or more evaporator fans 134 move air over the evaporator 106 to supply cool air. As the mixture flows through evaporator 106, heat is absorbed, causing the mixture to change phase to a low-pressure, low-temperature liquid. When no liquid refrigerant remains in the evaporator, the refrigerant increases in temperature. As the mixture exits the condenser it enters evaporator output line 120, then exits the InRow unit 124, and then enters the condensing unit 126 through suction line 122, which thereby supplies compressor 104 with a low-pressure mixture to compress into a high-pressure mixture once more.

Embodiments of system 100 are not limited to only those elements illustrated in FIG. 1. Embodiments of system 100 may include more or fewer components than as illustrated in FIG. 1. In some embodiments, system 100 includes one or more additional components such as one or more ball valves, service ports, filter driers, sight glasses, distributors, temperature sensors, pressure sensors, pressure transducers, unions, humidity sensors, air filters, and pressure cutouts.

Figure 2:
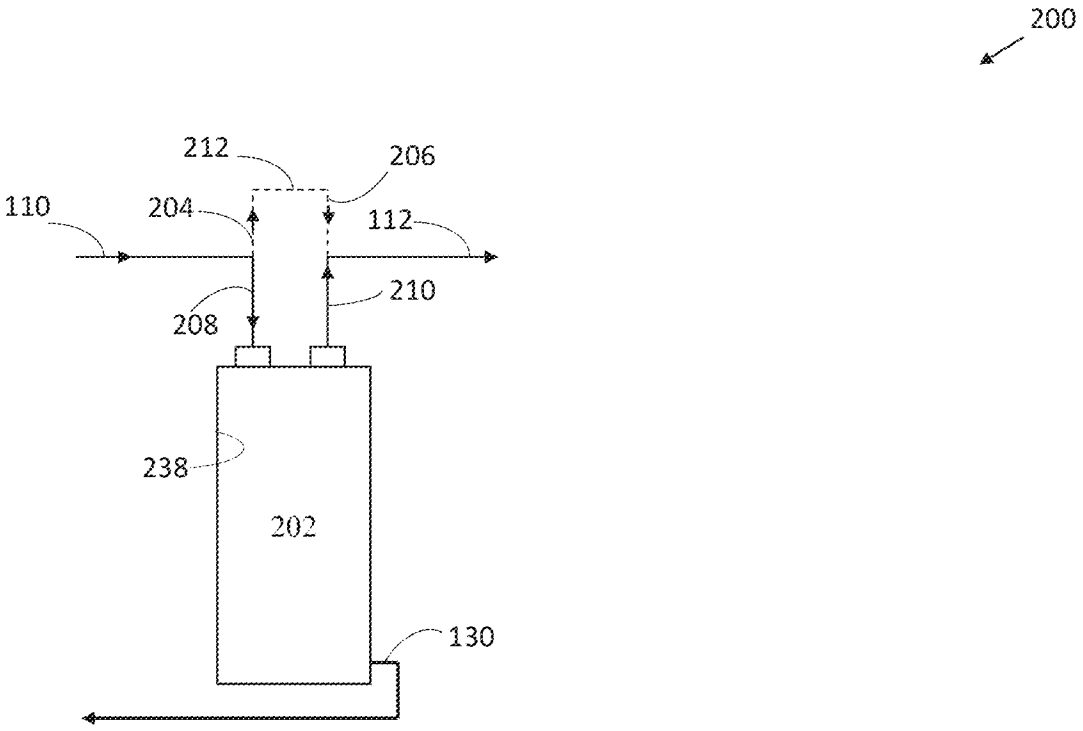
FIG. 2 is a block diagram of a filter-type oil separator subsystem including a bypass line, according to aspects described herein.

FIG. 2 is a block diagram illustrating one embodiment of oil separator subsystem 102 shown in FIG. 1 including a filter-type oil separator configuration 200, which includes the discharge line 110, the condenser input line 112, the oil return tube 130, a filter-type oil separator 202, a bypass input line 204, a bypass output line 206, a filter input line 208, a filter output line 210, a bypass line 212, and an inner wall 238 of filter-type oil separator 202. Redundant discussion of elements in common with embodiments above will be omitted for purposes of brevity.

Discharge line 110 is coupled to bypass input line 204 and coupled to filter input line 208 to provide fluid communication between discharge line 110, bypass input line 204, and filter input line 208. Bypass input line 204 is coupled to filter input line 208. Filter input line 208 is coupled to filter-type oil separator 202. Bypass input line 204 is coupled to bypass line 212, which is coupled to bypass output line 206. Bypass output line 206 is coupled to condenser input line 112 to thereby provide fluid communication between discharge line 110, bypass input line 204, bypass line 212, bypass output line 206, and condenser input line 112. Filter-type oil separator 202 is coupled to filter output line 210, which is coupled to bypass output line 206 and coupled to condenser input line 112 to thereby provide fluid communication between discharge line 110, filter input line 208, filter-type oil separator 202, filter output line 210, and condenser input line 112. Filter-type oil separator 202 is coupled to oil return tube 130.

In some embodiments, bypass input line 204, bypass output line 206, and bypass line 212 are a single, continuous section of piping. In some embodiments, each of bypass input line 204, bypass output line 206, and bypass line 212 is a separate section of piping. The section(s) of piping or tubing that includes input line 204, bypass output line 206, and bypass line 212 acts as a bypass configured to receive at least a portion of the mixture flowing through discharge line 110 and bypass the portion around filter-type oil separator 202. The remaining portion of the mixture that is not bypassed flows through filter input line 208 into filter-type oil separator 202.

The addition of a bypass between discharge line 110 and condenser input line 112 allows the vapor mixture flowing through discharge line 110 to pass through oil separator 202 and the bypass line 212 simultaneously, thereby reducing the flow of vapor entering oil separator 202. Compared to a compressor speed value without utilizing a bypass between discharge line 110 and condenser input line 112, using the bypass between discharge line 110 and condenser input line 112 allows for more lubricating oil reclamation at the same compressor speed value.

In some embodiments, compressor speed is proportional to mixture flow rate leaving a compressor 104. In some embodiments, the flow of vapor, gas, and/or liquid refrigerant facilitates transportation of the lubricating oil circulating through piping of system 100. A higher refrigerant flow rate corresponds to a higher lubricating oil rate. By reducing the refrigerant flow rate within the filter-type oil separator 202, more lubricating oil is accumulated in the bottom of filter-type oil separator 202 and returned to compressor 104 through oil return tube 130.

In some embodiments, oil separator configuration 200 is implemented in a different system than system 100.

Figure 3:
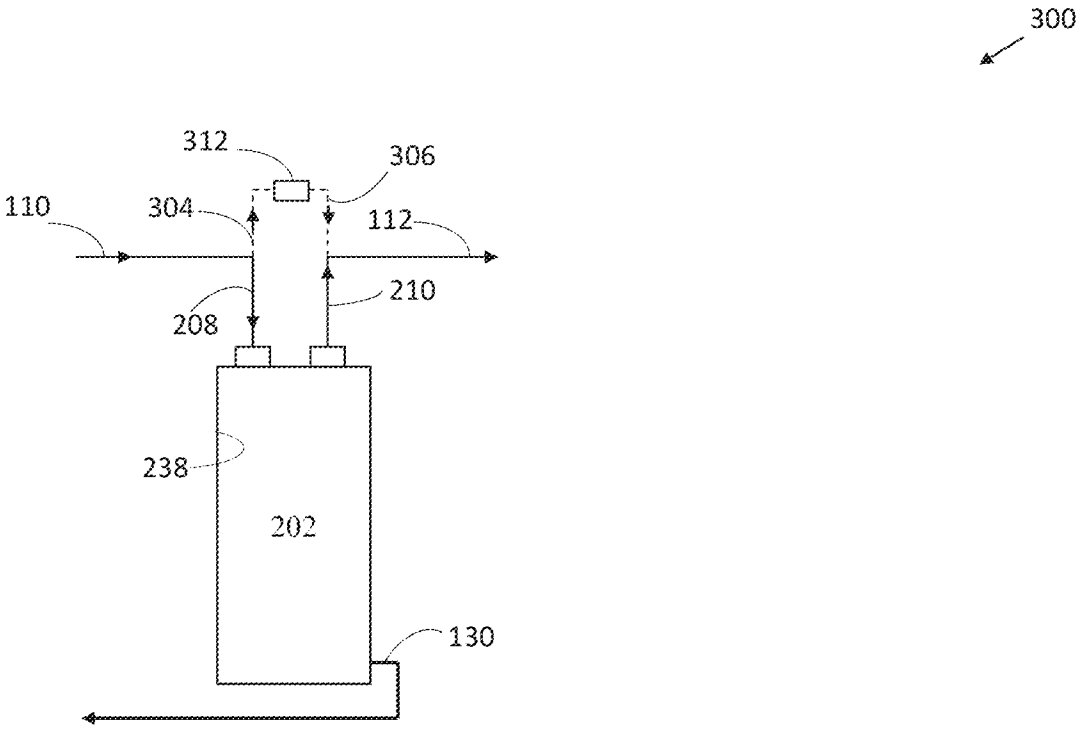
FIG. 3 is a block diagram of a filter-type oil separator subsystem including a bypass valve, according to aspects described herein.

FIG. 3 is a block diagram illustrating one embodiment of oil separator subsystem 102 shown in FIG. 1 including a filter-type oil separator configuration 300, which includes the discharge line 110, the condenser input line 112, the oil return tube 130, the filter-type oil separator 202, the filter input line 208, the filter output line 210, an inner wall 238 of filter-type oil separator 202, a bypass input line 304, a bypass output line 306, and a bypass valve 312. Redundant discussion of elements in common with embodiments above will be omitted for purposes of brevity.

Filter-type oil separator configuration 300 differs from filter-type oil separator configuration 200 by including the bypass valve 312, which is coupled to bypass input line 304 and bypass output line 306 to thereby provide fluid communication between discharge line 110, bypass input line 304, bypass valve 312, bypass output line 306, and condenser input line 112. The bypass input line 304 is coupled to discharge line 110 to receive at least a portion of the mixture output by the compressor 104, and coupled to filter input line 208 to thereby provide at least a portion of the mixture output by the compressor 104 to filter-type oil separator 202. Filter output line 210 is coupled to bypass output line 306 and condenser input line 112 to thereby provide a filtered mixture to condenser 128 having less oil than the mixture received by filter-type oil separator 202.

The bypass valve 312 is configured to receive at least a portion of the mixture flowing through discharge line 110 and bypass the portion around filter-type oil separator 202. The bypass valve 312 is configured to adjust the cross-sectional area within the bypass. The bypass valve 312 is configured to adjust the cross-sectional area within a range of 0% to 100% (i.e., fully closed to fully open).

In some embodiments, the bypass valve 312 is a ball valve. Depending on the design requirements of the system within which filter-type oil separator configuration 300 is installed, the bypass valve 312 is configured to be set to a fixed position such that the cross-sectional area of internal piping controlled by the ball valve is set to a fixed cross-sectional area, thereby adjusting the amount of cross-sectional area for the mixture to pass through.

In some embodiments, the bypass valve 312 is a hot gas bypass valve. A hot gas bypass valve opens in response to decreased downstream pressure and modulates from a fully closed position to a fully open position.

In some embodiments, the bypass valve 312 is a non-electronic hot gas bypass valve. In some embodiments, the non-electric hot gas bypass valve is set to start opening to a specified evaporating temperature. This setting can be changed by turning a setting spindle, screw, or spring.

In some embodiments, the bypass valve 312 is an electronic bypass valve coupled to and controlled by a controller.

In some embodiments, the electronic bypass valve is an electronically controlled hot gas bypass valve. In some embodiments, the electronic hot gas bypass valve is coupled to a controller, e.g., controller 108 shown in FIG. 1. The electronic hot gas bypass valve modulates the amount of mixture allowed to pass through based on signals received from a controller. In some embodiments, the signals control an internal electric motor that is configured to be driven to properly achieve a desired valve position in a range from a fully closed position to a fully open position.

In some embodiments, oil separator configuration 300 is implemented in a different system than system 100.

Figure 4:
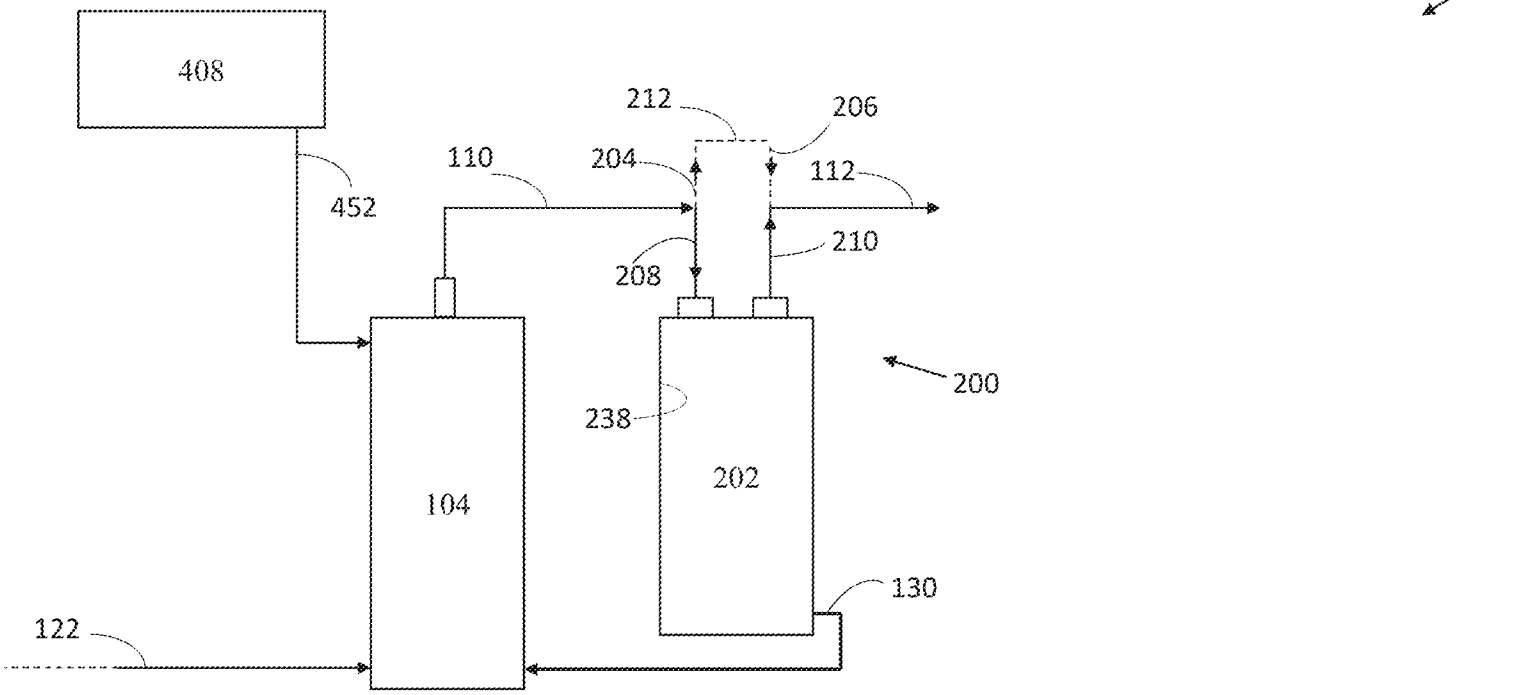
FIG. 4 is a block diagram of a configuration of a controller and a bypass line, according to aspects described herein.

FIG. 4 is a block diagram of a configuration 400 of an embodiment of the disclosure. As shown, configuration 400 is included within system 100 shown in FIG. 1, and additionally includes a controller 408 and a control line 452 coupled to filter-type oil separator configuration 200. Controller 408 is equivalent to controller 108, and additionally includes the control line 452. Redundant discussion of elements in common with embodiments above will be omitted for purposes of brevity.

Control line 452 is coupled to the compressor 104. In some embodiments, the controller 408 is configured to set a target compressor speed of the compressor 104 by sending a signal from the controller 408 to the compressor 104 along control line 452. The target speed is a desired speed.

Certain embodiments include a variable speed compressor including the compressor 104 and a driver configured to control the speed of the compressor 104. In such embodiments, the controller 408 is configured to set the target speed of the compressor 104 by sending a command to the driver to set a driving frequency of the compressor (i.e., compressor target speed). In some embodiments, the driving frequency has a one-to-one correspondence with the compressor's target speed. In an example of the one-to-one correspondence, driving frequency is 60 Hz and the target speed of the compressor 104 is 60 Revolutions Per Second (RPS).

To control the driver based on temperature feedback, certain embodiments include a proportional integral derivative (PID) controller 418 that is configured to implement a control loop to regulate the target speed of the compressor 104 based on feedback of one or more temperature sensors. In some embodiments, the one or more sensors include one or more of a return air supply sensor and a supply air temperature sensor. The PID controller 418 receives a desired air temperature setpoint and then calculates the error between the temperature setpoint and the measured air temperature from the air supply sensor and/or the return air temperature sensor. In some embodiments, the air supply sensor is configured to receive air supplied by the condenser evaporator 106 and the return air supply temperature is configured to receive air supplied by the condenser 128.

Based on the calculated error, the target speed of the compressor 104 is either decreased, maintained, or increased by the PID controller 418. In some embodiments, the controller 408 implements the functionality of the PID controller 418. In other embodiments, the PID controller 418 is implemented in separate hardware, software, and/or firmware from the controller 408 and sends a signal along one or more controller input lines 140 to provide the controller 408 with a target speed of the compressor 104.

In some embodiments, the controller 408 is configured to receive one or more input signals. Some embodiments include the one or more input signals corresponding to the target compressor speed of the compressor 104.

In some embodiments, configuration 400 is implemented in a different system than system 100.

Figure 5:
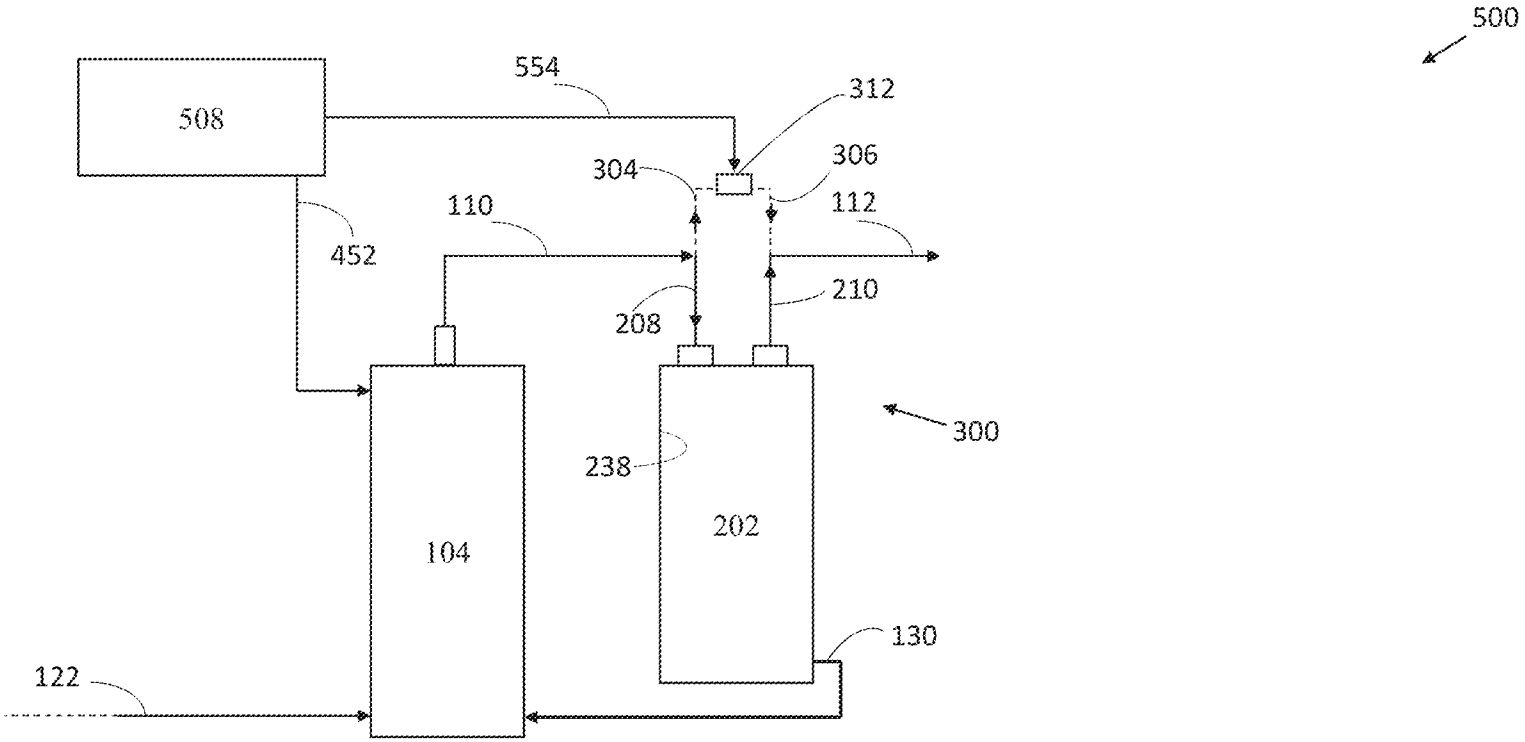
FIG. 5 is a block diagram of a configuration of a controller and a bypass valve, according to aspects described herein.

FIG. 5 is a block diagram of a configuration 500 of an embodiment of the disclosure. As shown, configuration 500 is included in system 100 shown in FIG. 1, and additionally includes a controller 508, a control line 452, a control line 554, and filter-type oil separator configuration 300. Controller 508 is equivalent to controller 408, and additionally includes control line 554. Redundant discussion of elements in common with embodiments above will be omitted for purposes of brevity.

Control line 452 is coupled to compressor 104. Control line 554 is coupled to the bypass valve 312.

In some embodiments, controller 508 is configured to control the bypass valve 312 by adjusting or setting the bypass valve 312 to a predetermined amount of valve openness (i.e., an amount between 0% to 100%, inclusive). The adjustment is made by sending a signal from controller 508 to the bypass valve 312 along control line 554. Controller 508 determines the predetermined amount of valve openness based on a relationship between an RPS value of the compressor 104 and a percentage of valve openness of the bypass valve 312. The compressor RPS value is determined by controller 508 from one or more input signals.

Certain embodiments of configuration 500 include embodiments of the PID controller 418. In such embodiments of configuration 500, the PID controller 418 receives a desired temperature setpoint and calculates the error between measured temperature and the temperature setpoint, thereby instructing the controller 508 to set the target speed of the compressor 104 by sending a signal to the compressor 104 via the control line 452. In some embodiments, in addition to commanding the compressor 104 to achieve the desired target speed, the controller 508 is also configured to receive the calculated target speed of the compressor 104 from the PID controller 418 and determine a percentage of valve openness for the bypass valve 312 corresponding to the target speed. The controller 508 is configured to set the bypass valve 312 to the percentage of valve openness via control line 554. As such, the efficiency of the oil separator 202 is optimized while the target speed of the compressor 104 is either decreased, maintained, or increased in response to the error calculation(s) of the PID controller 418, the target speed set by the controller 508, and the amount of openness for the bypass valve 312 determined by the controller 508.

In some embodiments, configuration 500 is implemented in a different system than system 100.

Figure 6:
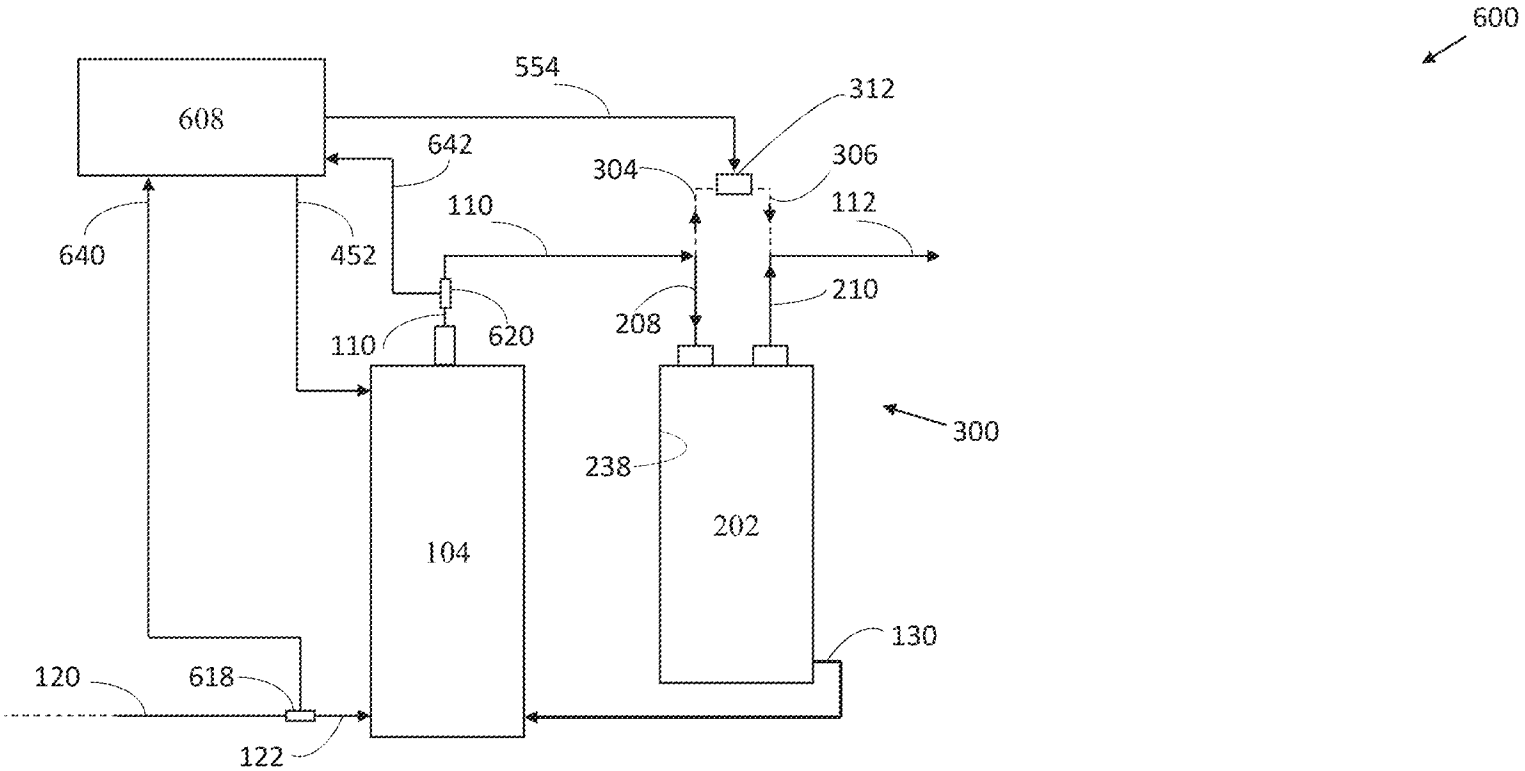
FIG. 6 is a block diagram of a configuration of a controller and a bypass valve, according to aspects described herein.

FIG. 6 is a block diagram of a configuration 600 of an embodiment of the disclosure. As shown, configuration 600 is included in system 100 shown in FIG. 1, and additionally includes a controller 608, a control line 452, a control line 554, a first pressure transducer 618, a second pressure transducer 620, a controller input line 640, a controller input line 642, and filter-type oil separator configuration 300. Controller 608 equivalent to controller 508, and additionally includes controller input line 640 and controller input line 642. Redundant discussion of elements in common with embodiments above will be omitted for purposes of brevity.

In some embodiments, first pressure transducer 618 is located within InRow unit 124 and second pressure transducer 620 is located within condensing unit 126. In some embodiments, first pressure transducer 618 and second pressure transducer 620 are both located within condensing unit 126. In some embodiments, first pressure transducer 618 and second pressure transducer 620 are both located within InRow unit 124. In some embodiments, first pressure transducer 618 and second pressure transducer 620 are located externally to one or both of InRow unit 124 and condensing unit 126.

Control line 452 is coupled to the compressor 104. Control line 554 is coupled to the bypass valve 312. The first pressure transducer 610 is coupled to evaporator output line 120, controller input line 640, and suction line 122. The second pressure transducer 620 is coupled to controller input line 642 and coupled to compressor discharge line 110. Controller input line 640 and controller input line 642 are each coupled to controller 608.

In some embodiments, controller 608 is configured to receive one or more input signals from each of controller input line 640 and controller input line 642. Input signals from controller input line 640 correspond to one or more values indicating pressure of the mixture flowing from evaporator output line 120 to suction line 122. Input signals from controller input line 642 correspond to one or more values indicating pressure of the mixture flowing from compressor 104 to compressor discharge line 110.

In some embodiments, controller 608 is configured to control the bypass valve 312 by adjusting or setting the bypass valve 312 to a predetermined amount of valve openness (i.e., any amount from 0% to 100%). The adjustment is made by sending a signal from controller 608 to the bypass valve 312 along control line 554. In some embodiments, as an alternative to determining valve openness according to the target speed of the compressor 104, the controller 608 adjusts the bypass valve 312 based on a gas flow rate of the compressor 104. The controller 608 determines the gas flow rate, and thereby the amount of bypass valve 312 openness, by receiving a first pressure value from the first pressure transducer 618 at a suction side of compressor 104, receiving a second pressure value from the second pressure transducer 620 at the discharge side of the compressor, receiving compressor flow coefficients from a storage, and then determining the gas flow rate as a function of the first pressure value, the second pressure value, and the compressor flow coefficients. Controller 608 then determines the predetermined amount of valve openness of the bypass valve 312 based on a relationship between gas flow rate and valve openness. In some embodiments, the gas flow rate has a one-to-one correspondence with compressor RPS values.

Certain embodiments of configuration 600 include the embodiments of the PID controller 418 in configuration 400 and/or configuration 500. In such embodiments of configuration 600, the PID controller 418 receives a desired temperature setpoint and calculates the error between measured temperature and the temperature setpoint, thereby instructing the controller 608 to set the target speed of the compressor 104 by sending a signal to the compressor 104 via the control line 452. In some embodiments, in addition to commanding the compressor 104 to achieve the desired target speed, the controller 508 is also configured to determine the predetermined amount of valve openness of the bypass valve 312 based on the relationship between gas flow rate and valve openness. As such, the efficiency of the oil separator 202 is optimized while the target speed of the compressor 104 is either decreased, maintained, or increased in response to the error calculation(s) of the PID controller 418, the target speed set by the controller 608, the gas flow rate, and the amount of openness for the bypass valve 312 determined by the controller 608. In some embodiments, configuration 600 is implemented in a different system than system 100.

Figure 7:
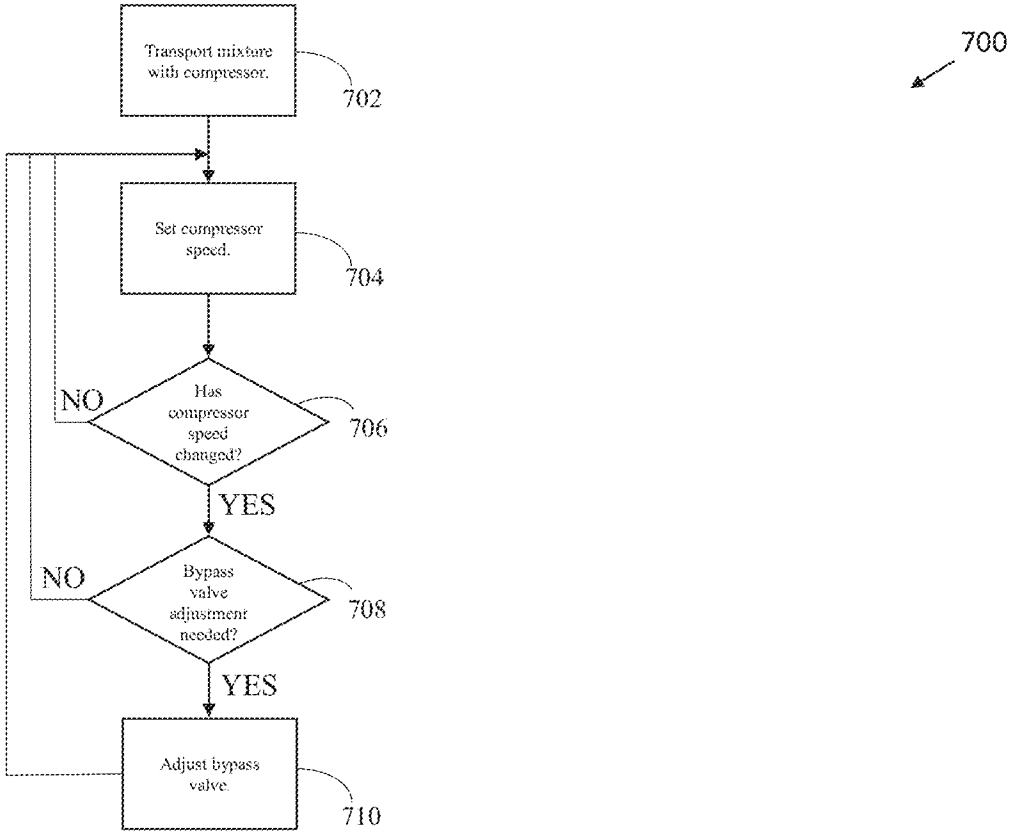
FIG. 7 is a flowchart of a method for determining bypass valve adjustment utilizing embodiments described herein.

FIG. 7 is a flowchart of a method 700 for determining bypass valve adjustment in a control loop. Method 700 includes steps 702, 704, 706, 708, and 710.

In step 702, compressor 104 is instructed to pump and circulate a mixture of lubricating oil and refrigerant. If compressor 104 is instructed to cease pumping, then method 700 ends.

In step 704, a target compressor speed of the compressor 104 is set. In some embodiments, the target speed is set directly by receiving a value used to control compressor 104 at a predetermined speed. In some embodiments, the speed is determined indirectly by receiving one or more values corresponding to a pressure at a suction side of compressor 104, one or more values corresponding to a pressure at a discharge side of compressor 104, and one or more values of compressor flow coefficients. One or more embodiments include setting the target speed based on a calculation from the PID controller 418 and/or one of the controller 108, the controller 408, the controller 508, and the controller 608.

In step 706, a determination is made whether the target compressor speed has changed since the previous instance of step 706 based on one or more criteria.

In one example of a criterion in step 706, if the target compressor speed changes from 45 RPS to 55 RPS and the criterion is the speed must be different by more than 5 RPS, the criterion is satisfied ("YES" in step 706) and method 700 proceeds to step 708.

In another example of a criterion in step 706, if the target compressor speed was 45 RPS at the previous instance of step 706 and is 45 RPS in the current instance of step 706, and the criterion is the current speed and the previous speed must be a different value, then the criterion is not satisfied ("NO" in step 706) and method 700 returns to step 704.

In some embodiments, the criterion in step 706 is any change in target compressor speed. In one example, if the criterion was any determined change, then a change from 49 RPS to 50 RPS would indicate a change and method 700 proceeds to step 708.

In step 708, a determination is made whether the bypass valve 312 needs adjustment according to one or more criteria. In one example of a criterion in step 708, the criterion is based on a predetermined relationship or function between a range of valve openness percentages (e.g., 0% to 100%) and a range of possible target compressor speed values (e.g., 0 RPS to 90 RPS).

Figure 8:
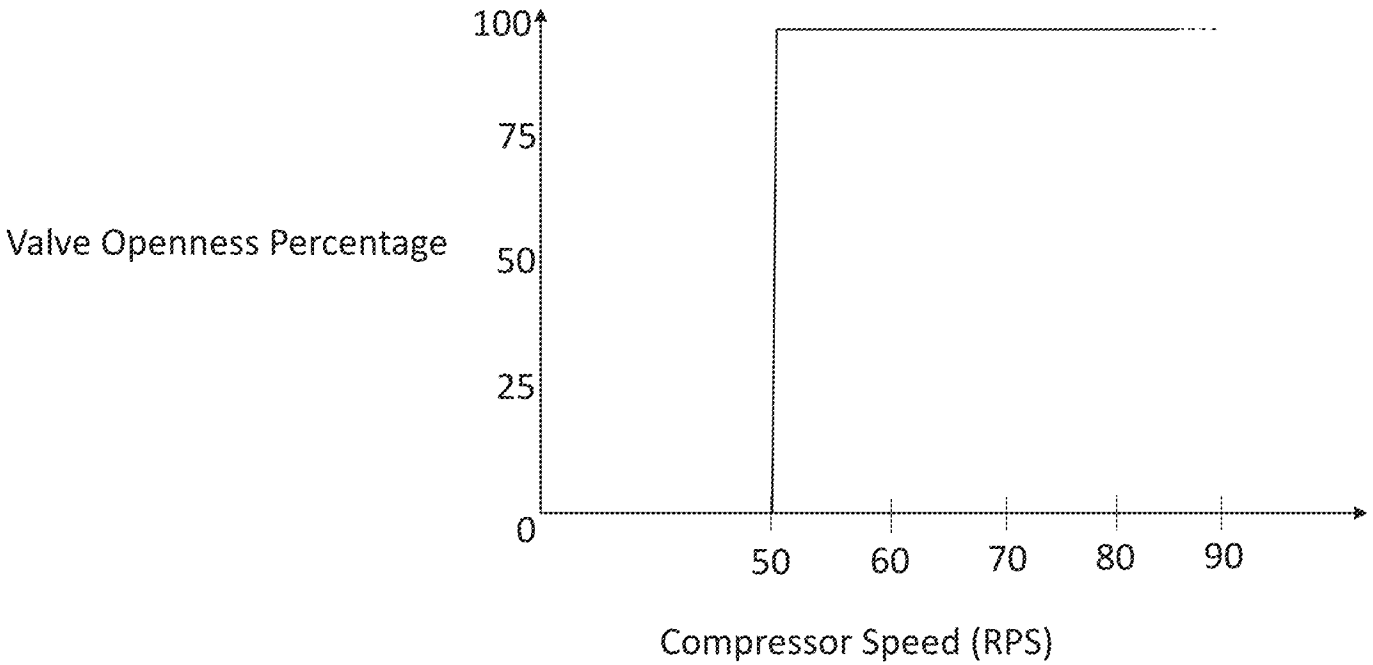
FIG. 8 is a chart illustrating a relationship between bypass valve adjustment and compressor speed, according to aspects described herein.

In one example of the criterion in step 708, the relationship is defined by the graph illustrated in FIG. 8. If the previous target compressor speed was 40 RPS and the current target compressor speed is 45 RPS, then the bypass valve remains closed (i.e., 0% valve openness percentage) and method 700 returns to step 704 ("NO" in step 708). If in the next instance of step 708, the target compressor speed has changed from 45 RPS to 52 RPS, then the bypass valve 312 is instructed to fully open in step 710 (i.e., 100% valve openness percentage.

Figure 9:
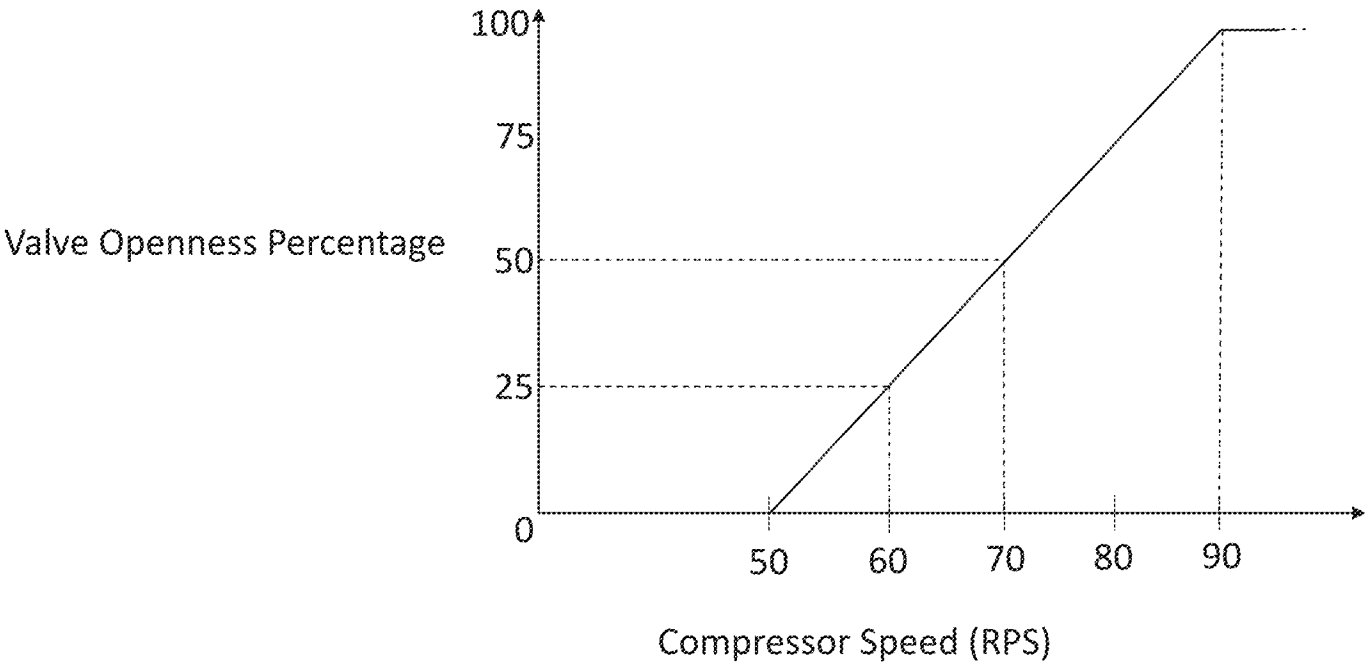
FIG. 9 is a chart illustrating a relationship between bypass valve adjustment and compressor speed, according to aspects described herein.

In another example of the criterion in step 708, the relationship is defined by the graph illustrated in FIG. 9. If a previous target compressor speed value was 45 RPS and the current target compressor speed value is 60 RPS, then method 700 proceeds to step 710 and the bypass valve 312 is instructed to open to a value of 25% total openness. In the next instance of step 708, assuming step 706 is "YES," if the next compressor speed value is 70 RPS, then method 700 proceeds to step 710 and the bypass valve 312 is instructed to open further to 50% total openness. If, however, the next target compressor speed value was 49 RPS instead of 70 RPS, then the bypass valve 312 is instructed in step 710 to close completely (i.e., 0% valve openness percentage).

Method 700 is performed with any system, controller, or configuration disclosed herein including but not limited to system 100, configuration 400, configuration 500, configuration 600, and embodiments including the PID controller 418, the controller 108, the controller 408, the controller 508, and the controller 608. In some embodiments, method 700 is performed by special-purpose hardware.

FIGS. 8-14 each illustrate a different relationship to be utilized in step 708. The dashed line extending beyond 90 RPS in each figure except FIG. 10 indicates the relationship holds for higher RPS values. Although FIGS. 8-14 illustrate functions beginning and ending at specific compressor speed values and valve openness percentages, these values are meant to be illustrative of examples of embodiments. Other values are within the scope of embodiments disclosed herein. FIGS. 8-14 are intended to be non-limiting examples of possible relationships utilized in step 708 of method 700. Other modifications or combinations of portions of the disclosed relationships are within the skill of one of ordinary skill in the art.

FIG. 8 illustrates a non-linear relationship over a compressor speed range of 0 RPS to 90 RPS. RPS values below 50 RPS correspond to the bypass valve 312 set to fully closed, while values of 50 RPS or higher correspond to the bypass valve 312 set to fully open.

FIG. 9 illustrates a linear relationship over a compressor speed range of 50 RPS to 90 RPS. RPS values below 50 RPS correspond to the bypass valve 312 set to fully closed, while values of 50 RPS or higher, up to 90 RPS, correspond to a linearly increasing amount of valve openness. At values higher than 90 RPS, the bypass valve 312 remains fully open.

Figure 10:
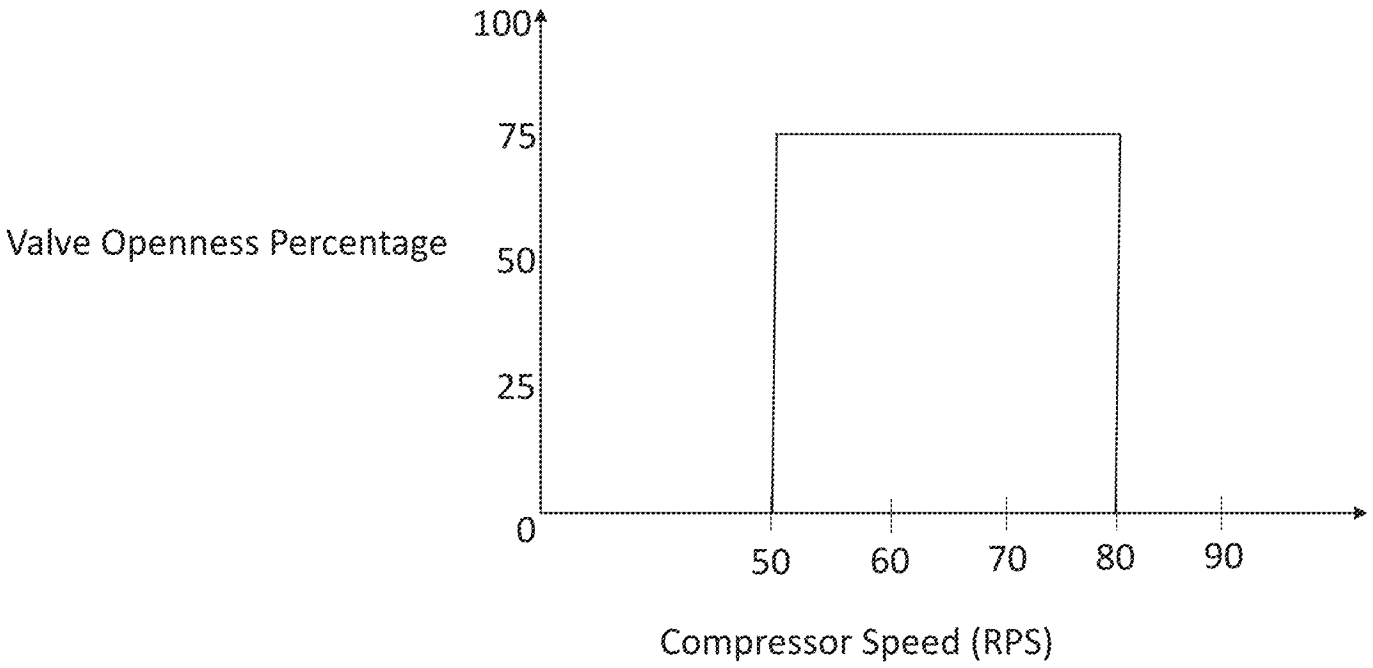
FIG. 10 is a chart illustrating a relationship between bypass valve adjustment and compressor speed, according to aspects described herein.

FIG. 10 illustrates a non-linear relationship over a compressor speed range of 0 RPS to 90 RPS. RPS values below 50 RPS correspond to the bypass valve 312 set to fully closed. RPS values from 50 RPS to 80 RPS correspond to the bypass valve 312 set to 75% open. Values higher than 80 RPS correspond to the bypass valve 312 set to fully closed.

Figure 11:
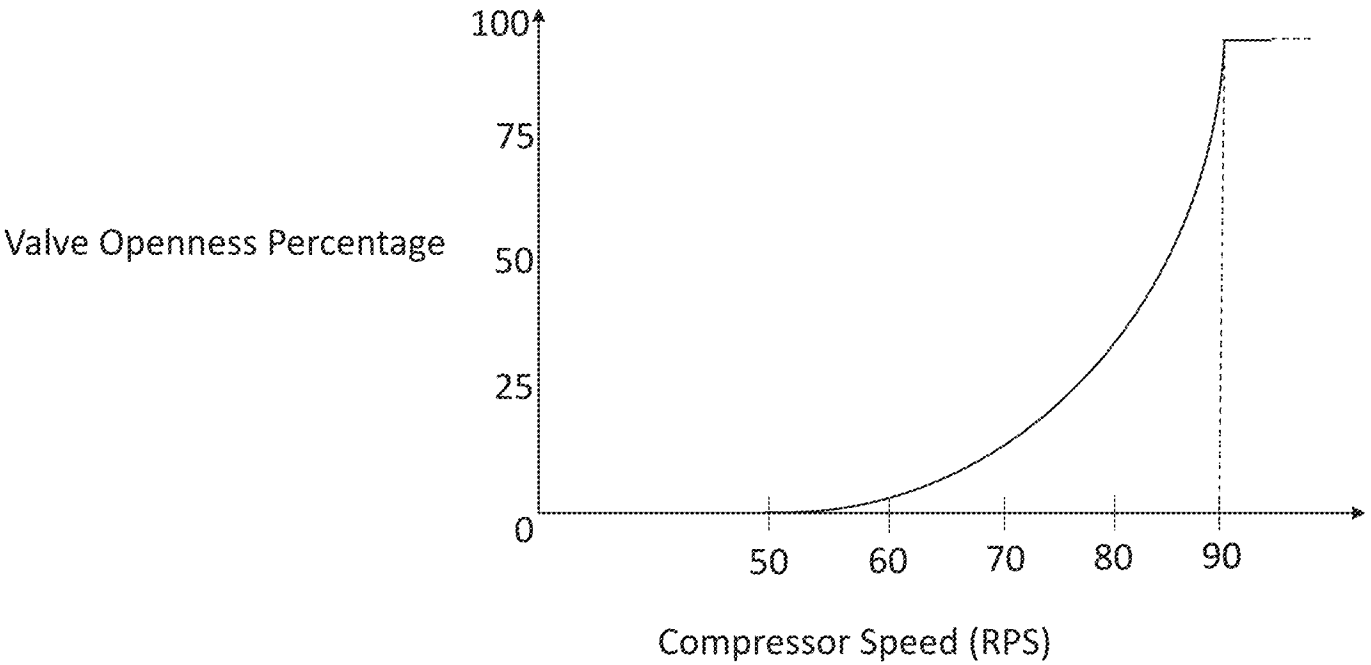
FIG. 11 is a chart illustrating a relationship between bypass valve adjustment and compressor speed, according to aspects described herein.

FIG. 11 illustrates a non-linear relationship over a compressor speed range of 50 RPS to 90 RPS. RPS values below 50 RPS correspond to the bypass valve 312 set to fully closed, while values of 50 RPS or higher correspond to a non-linearly increasing amount of valve openness. At values higher than 90 RPS, the bypass valve 312 remains fully open.

Figure 12:
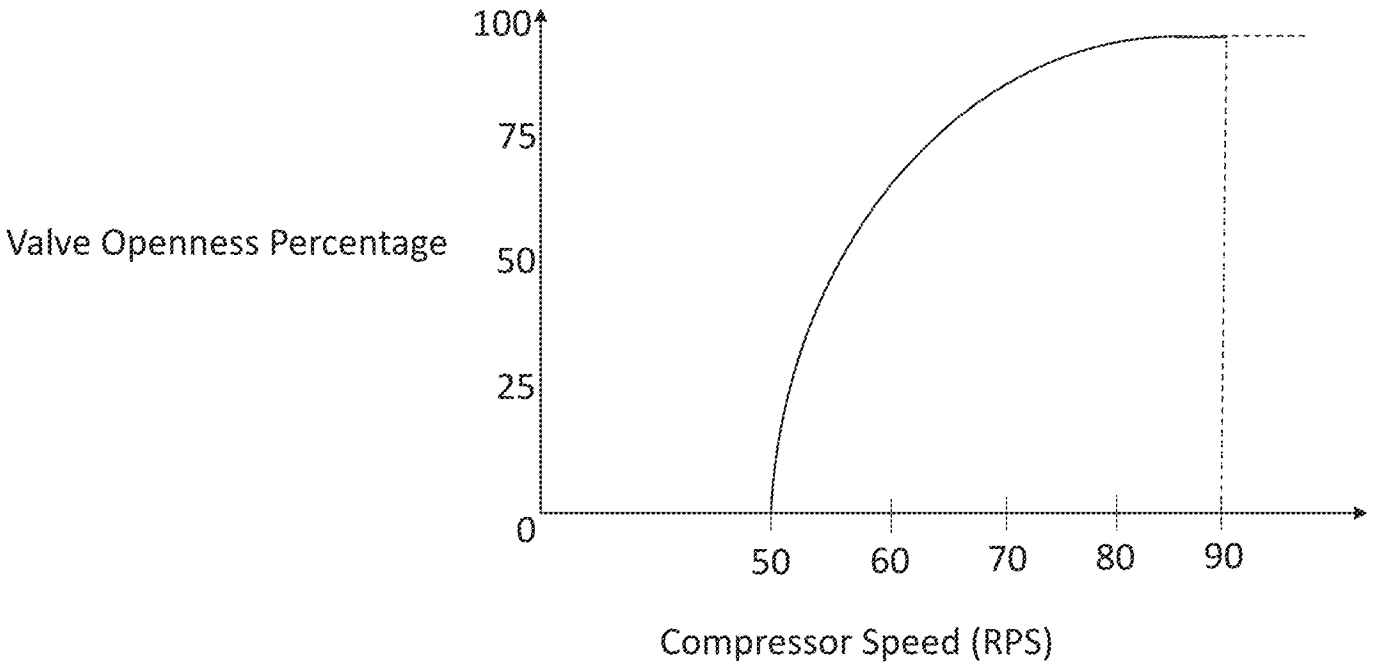
FIG. 12 is a chart illustrating a relationship between bypass valve adjustment and compressor speed, according to aspects described herein.

FIG. 12 illustrates a non-linear relationship over a compressor speed range of 50 RPS to 90 RPS. RPS values below 50 RPS correspond to the bypass valve 312 set to fully closed, while values of 50 RPS or higher correspond to a non-linearly increasing amount of valve openness. At values higher than 90 RPS, the bypass valve 312 remains fully open.

Figure 13:
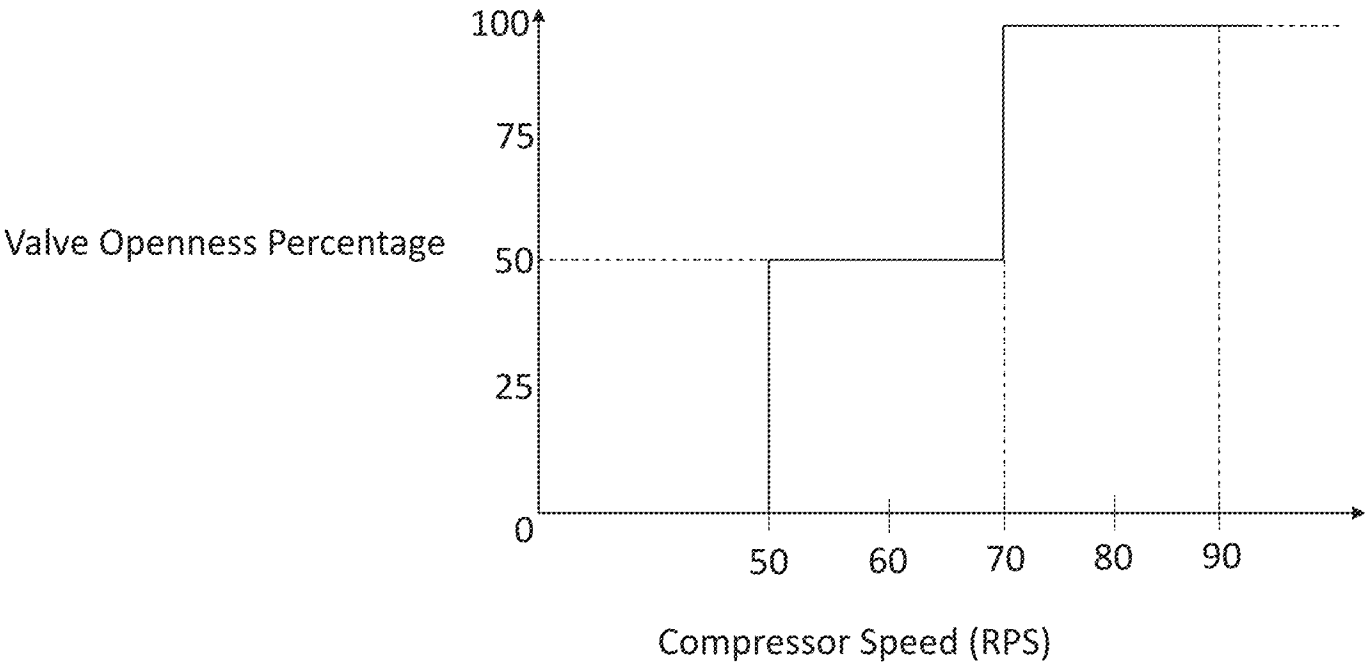
FIG. 13 is a chart illustrating a relationship between bypass valve adjustment and compressor speed, according to aspects described herein.

FIG. 13 illustrates a non-linear relationship over a compressor speed range of 0 RPS to 90 RPS. RPS values below 50 RPS correspond to the bypass valve 312 set to fully closed. RPS values from 50 RPS to 70 RPS correspond to the bypass valve 312 set to 50% open. RPS values higher than 70 RPS correspond to the bypass valve 312 set to fully open.

Figure 14:
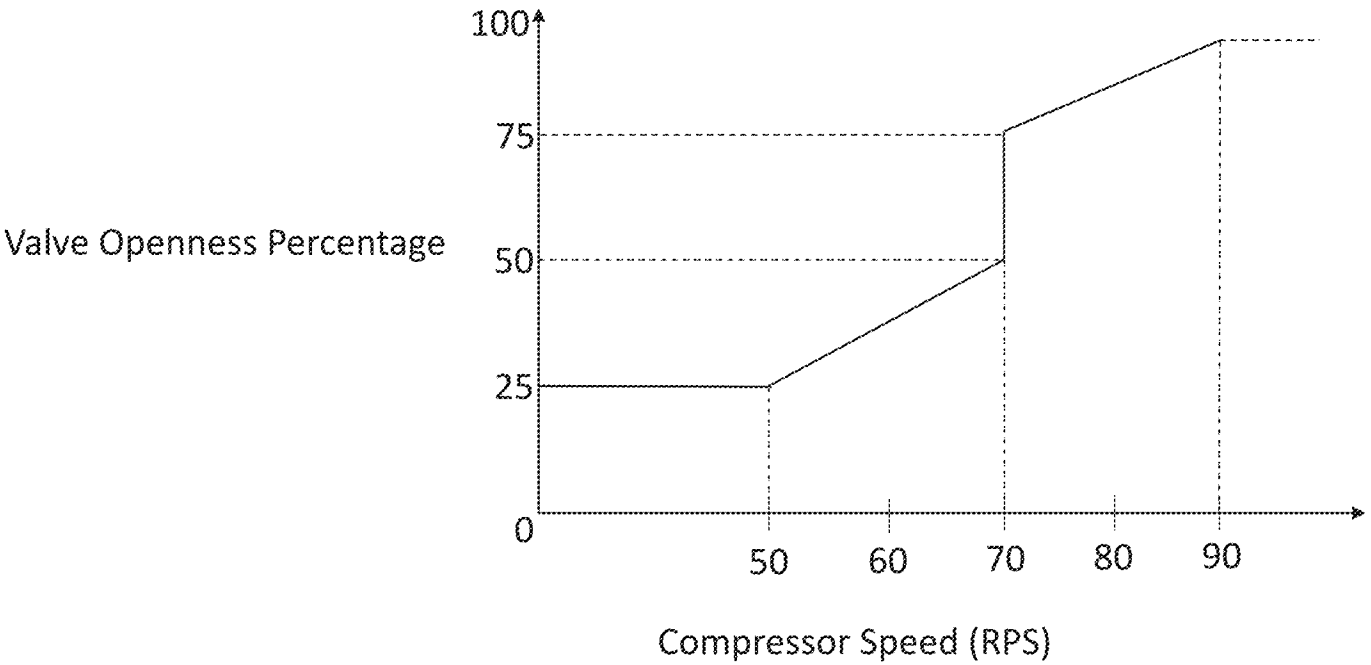
FIG. 14 is a chart illustrating a relationship between bypass valve adjustment and compressor speed, according to aspects described herein.

FIG. 14 illustrates a non-linear relationship over a compressor speed range of 0 RPS to 50 RPS, a linear relationship between 50 RPS and 70 RPS, and a linear relationship between 70 RPS and 90 RPS. RPS values below 50 RPS correspond to the bypass valve 312 set to 25% open. RPS values from 50 RPS to 70 RPS correspond to linearly increasing values of valve openness. RPS values higher than 70 RPS up to 90 RPS linearly increase by the same amount or a different amount than the linear relationship in the range of 50 RPS to 70 RPS. RPS values higher than 90 RPS correspond to the bypass valve 312 set to fully open.

Figure 15:
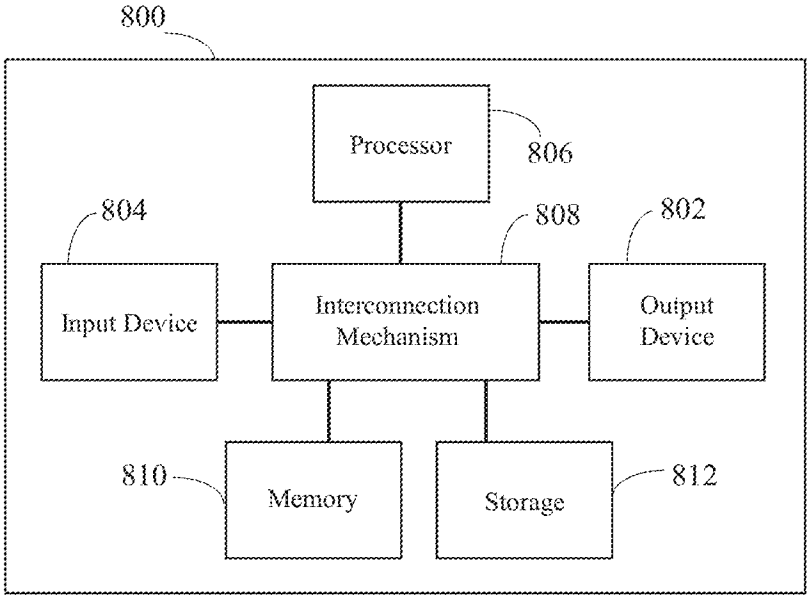
FIG. 15 is a system utilizing one or more embodiments described herein.

FIG. 15 illustrates an example block diagram of computing components forming a system 800 which may be configured to implement one or more aspects disclosed herein. For example, the system 800 may be communicatively coupled to controller 108, controller 408, controller 508, or controller 608.

The system 800 may include for example a computing platform such as those based on Intel PENTIUM-type processor, Motorola PowerPC, Sun UltraSPARC, Texas Instruments-DSP, Hewlett-Packard PA-RISC processors, or any other type of processor. System 800 may include specially-programmed, special-purpose hardware, for example, an application-specific integrated circuit (ASIC). Various aspects herein may be implemented as specialized software executing a method on the system 800 such as that shown in FIG. 15.

The system 800 may include a processor 806 connected to one or more memory devices 810, such as a disk drive, memory, flash memory or other device for storing data. Processor 806 may be an ASIC. Memory 810 may be used for storing programs and data during operation of the system 800. Components of the computer system 800 may be coupled by an interconnection mechanism 808, which may include one or more buses (e.g., between components that are integrated within a same machine) and/or a network (e.g., between components that reside on separate machines). The interconnection mechanism 808 enables communications (e.g., data, instructions) to be exchanged between components of the system 800. The system 800 also includes one or more input devices 804, which may include for example, a keyboard or a touch screen. The system 800 includes one or more output devices 802, which may include, for example, a display. In addition, the computer system 800 may contain one or more interfaces (not shown) that may connect the computer system 800 to a communication network, in addition or as an alternative to the interconnection mechanism 808.

The system 800 may include a storage system 812, which may include a computer readable and/or writeable nonvolatile medium in which signals may be stored to provide a program to be executed by the processor or to provide information stored on or in the medium to be processed by the program. The medium may, for example, be a disk or flash memory and in some examples may include RAM or other non-volatile memory such as EEPROM. The medium may, for example, be a non-transitory computer readable medium storing thereon sequences of computer-executable instructions for controlling a power converter system including a controller, the sequences of computer-executable instructions that instruct the controller to perform any of the methods disclosed herein with any of the systems disclosed herein.

In some embodiments, the processor may cause data to be read from the nonvolatile medium into another memory 810 that allows for faster access to the information by the processor/ASIC than does the medium. This memory 810 may be a volatile, random access memory such as a dynamic random access memory (DRAM) or static memory (SRAM). It may be located in storage system 812 or in memory system 810. The processor 806 may manipulate the data within the integrated circuit memory 810 and then copy the data to the storage 812 after processing is completed. A variety of mechanisms are known for managing data movement between storage 812 and the integrated circuit memory element 810, and the disclosure is not limited thereto. The disclosure is not limited to a particular memory system 810 or a storage system 812.

The system 800 may include a computer platform that is programmable using a high-level computer programming language. The system 800 may be also implemented using specially programmed, special purpose hardware, e.g., an ASIC. The system 800 may include a processor 806, which may be a commercially available processor such as the well-known Pentium class processor available from the Intel Corporation. Many other processors are available. The processor 806 may execute an operating system which may be, for example, a Windows operating system available from the Microsoft Corporation, MAC OS System X available from Apple Computer, the Solaris Operating System available from Sun Microsystems, or UNIX and/or LINUX available from various sources. Many other operating systems may be used.

The processor and operating system together may form a computer platform for which application programs in high-level programming languages may be written. It should be understood that the disclosure is not limited to a particular computer system platform, processor, operating system, or network. Also, it should be apparent to those skilled in the art that the embodiments herein are not limited to a specific programming language or computer system. Further, it should be appreciated that other appropriate programming languages and other appropriate computer systems could also be used.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method for improving the efficiency of a filter-type oil separator, the method comprising:

determining a gas flow rate;

determining a correspondence between a number of revolutions per second of a compressor and the gas flow rate;

determining a speed value based on the gas flow rate and the number of revolutions per second;

compressing a mixture of refrigerant and lubricant at a speed corresponding to the speed value;

responsive to compressing the mixture, providing a first portion of the mixture to a filter-type oil separator;

responsive to compressing the mixture, providing a second portion of the mixture to a bypass line; and responsive to compressing the mixture, adjusting a bypass valve coupled to the bypass line based on the speed value.

2. The method of claim 1 wherein the gas flow rate is a refrigerant gas flow rate based on a flow rate of the mixture.

3. The method of claim 1 further comprising bypassing the second portion of the mixture around the filter-type oil separator through the bypass valve.

4. The method of claim 1 wherein the gas flow rate is measured at a discharge side of the compressor.

5. The method of claim 1 wherein determining the gas flow rate includes:

determining a first pressure value corresponding to a first pressure at an input of the compressor;

determining a second pressure value corresponding to a second pressure at an output of the compressor; and determining one or more compressor flow coefficients contained in a storage medium.

6. The method of claim 5 wherein the speed value further is determined based on the first pressure value, the second pressure value, and the one or more compressor flow coefficients.

7. The method of claim 1 further comprising:

opening the bypass valve responsive to determining that the speed value exceeds a threshold; and closing the bypass valve responsive to determining that the speed value is less than or equal to the threshold.

8. The method of claim 1 further comprising:

determining whether the speed value exceeds a threshold;

responsive to determining that the speed value exceeds the threshold, opening the bypass valve to a predetermined percentage of openness based on the speed value and the threshold;

responsive to opening the bypass valve to the predetermined percentage of openness, determining whether the speed value increased;

responsive to determining that the speed value increased, opening the bypass valve to a higher percentage of openness based on an increase in the speed value;

responsive to opening the bypass valve to the predetermined percentage of openness, determining whether the speed value decreased; and responsive to determining that the speed value decreased, adjusting the bypass valve to a lower percentage of openness based on a decrease in the speed value.

9. The method of claim 1 wherein adjusting the bypass valve coupled to the bypass line based on the speed value includes:

providing a first set of openness values including at least a first openness value, a second openness value, and a third openness value, wherein a first difference between the first openness value and the second openness value is different than a second difference between the second openness value and the third openness value, wherein the first openness value is less than the second openness value, and the second openness value is less than the third openness value; and adjusting the bypass valve to one of the first openness value, the second openness value, or the third openness value.

10. The method of claim 9 wherein the first difference and the second difference are related in a non-linear manner.

11. A non-transitory, computer-readable medium containing thereon one or more instructions for operating a filter-type oil separator, the instructions instructing at least one processor to:

determine a gas flow rate;

determine a correspondence between a number of revolutions per second of a compressor and the gas flow rate;

determine a speed value based on the gas flow rate and the number of revolutions per second;

control the compressor to compress a mixture of refrigerant and lubricant at a speed corresponding to the speed value;

responsive to controlling the compressor to compress the mixture, adjust a bypass valve coupled to a bypass line based on the speed value such that a first portion of the mixture is provided to the filter-type oil separator and a second portion of the mixture is provided to the bypass line.

12. The non-transitory computer-readable medium of claim 11 wherein the gas flow rate is a refrigerant gas flow rate based on a flow rate of the mixture.

13. The non-transitory computer-readable medium of claim 11, wherein the instructions further instruct the at least one processor to:

control the bypass valve to provide a bypass path for the second portion of the mixture, wherein the bypass path bypasses the second portion of the mixture around the filter-type oil separator.

14. The non-transitory computer-readable medium of claim 11 wherein the instructions instruct the at least one processor to:

determine the gas flow rate based on a measurement of the gas flow rate performed at a discharge side of the compressor.

15. The non-transitory computer-readable medium of claim 11, wherein the instructions further instruct the at least one processor to:

determine a first pressure value corresponding to a first pressure at an input of the compressor;

determine a second pressure value corresponding to a second pressure at an output of the compressor; and determine one or more compressor flow coefficients contained in a storage medium.

16. The non-transitory computer-readable medium of claim 15, wherein the instructions further instruct the at least one processor to determine the speed value based on the first pressure value, the second pressure value, and the one or more compressor flow coefficients.

17. The non-transitory computer-readable medium of claim 11, wherein the instructions further instruct the at least one processor to:

determine whether the speed value exceeds a threshold;

open the bypass valve responsive to determining that the speed value exceeds the threshold;

determine whether the speed value is less than or equal to the threshold; and close the bypass valve responsive to determining that the speed value is less than or equal to the threshold.

18. The non-transitory computer-readable medium of claim 11, wherein the instructions further instruct the at least one processor to:

determine whether the speed value exceeds a threshold;

responsive to determining that the speed value exceeds the threshold, open the bypass valve to a predetermined percentage of openness based on the speed value and the threshold;

responsive to opening the bypass valve to the predetermined percentage of openness, determine whether the speed value increased;

responsive to determining that the speed value increased, open the bypass valve to a higher percentage of openness based on an increase in the speed value;

responsive to opening the bypass valve to the predetermined percentage of openness, determine whether the speed value decreased; and responsive to determining that the speed value decreased, adjust the bypass valve to a lower percentage of openness based on a decrease in the speed value.

19. The non-transitory computer-readable medium of claim 11, wherein the adjusting the bypass valve includes the instructions further instructing the at least one processor to:

provide a first set of openness values including at least a first openness value, a second openness value, and a third openness value, wherein a first difference between the first openness value and the second openness value is different than a second difference between the second openness value and the third openness value, wherein the first openness value is less than the second openness value, and the second openness value is less than the third openness value; and adjust the bypass valve to one of the first openness value, the second openness value, or the third openness value.

20. The non-transitory computer-readable medium of claim 19 wherein the first difference and the second difference are related in a non-linear manner.

* * * * *